US005353607A

United States Patent [19]

McBride

[11] Patent Number: 5,353,607

[45] Date of Patent: Oct. 11, 1994

[54] COMBINATION COOLER AND RESERVOIR

[76] Inventor: Carla G. McBride, P.O. Box 20133, St. Louis, Mo. 63123

[21] Appl. No.: 1,324

[22] Filed: Jan. 7, 1993

[51] Int. Cl.[5] ..... F25D 3/08

[52] U.S. Cl. ..... 62/457.7; 62/291

[58] Field of Search ..... 62/457.1, 457.2, 457.5, 62/457.7, 312, 313, 291, 463

[56] References Cited

U.S. PATENT DOCUMENTS

| | | | |
|---|---|---|---|
| 2,450,305 | 9/1948 | Shoemaker | 62/291 |
| 2,762,203 | 9/1956 | Schlumbohm | 62/291 |
| 2,976,700 | 3/1961 | Jackson | 62/313 |
| 4,724,682 | 2/1988 | Flum et al. | 62/462 |
| 4,946,032 | 8/1990 | Stoddard et al. | 62/457.1 X |
| 5,048,171 | 9/1991 | Bidwell et al. | 62/463 X |
| 5,090,214 | 2/1992 | LoGioco | 62/457.7 |

*Primary Examiner*—Henry A. Bennet
*Assistant Examiner*—William C. Doerrler
*Attorney, Agent, or Firm*—Heller & Kepler

[57] ABSTRACT

A combination cooler and reservoir system to allow continuous drainage of water from a conventional insulated cooler is provided. A platform supports a cooler and houses a reservoir, the cooler and reservoir being connected by flexible tubing. The platform can be inclined to reduce the volume of water remaining in the cooler. This system prevents the accumulation of standing water in a cooler while storing the drained water for subsequent use.

15 Claims, 2 Drawing Sheets

COMBINATION COOLER AND RESERVOIR

BACKGROUND OF THE INVENTION

1. Field of the Invention

The present invention relates in general to combination cooler and reservoir systems, and more particularly to cooler drainage systems which provide continuous drainage of water from a cooler to a reservoir. Storage of drained water in a reservoir provides access to the water for uses such as cooking or bathing.

2. Prior Art

Conventionally, ice in a cooler is allowed to melt for extended periods of time before the accumulated water is drained from the cooler. The disadvantages of this method include having the contents of the cooler in standing water and limited access to the water in the cooler. Eventually, time must be taken to drain the cooler in a proper location to avoid unwanted spillage. This drainage of water is especially wasteful in situations such as camping or boating where water is scarce or limited.

Accordingly, it is an object of the present invention to provide a continuous drainage system for use with a commercially available insulated cooler. The present continuous drainage system insures the contents of the cooler are not surrounded by large amounts of standing water, while at the same time avoiding any unwanted leakage of water.

A further object of the present invention is to provide an easily removable reservoir to allow access to the stored water for uses such as cooking and bathing.

Still a further object of the present invention is to provide a cooler support platform to allow compact arrangement of the drainage system. The support platform of the present invention can be inclined to facilitate drainage from the cooler.

SUMMARY OF THE INVENTION

To accomplish to foregoing and other objects of this invention there is provided a platform to support a conventional insulated cooler, ice chest or ice container having a drainage port. The cooler is connected by tubing to a water reservoir located under the supported cooler. A reservoir can be provided by a basin which has an outlet tap to provide access to the stored water, or a collapsible or rigid waterproof water bladder which has the advantage of being more portable. Water bladders are commercially available for use in camping and boating to carry water. The bladder reservoir is optionally supported by a tray to allow removal of the bladder from under the cooler to another location.

In use, as ice melts in the cooler, the resulting water is continuously drained into the reservoir to protect the cooler contents from standing water, while preventing spillage or waste of water. The bladder reservoir can be removed from under the cooler and be placed in the sun for warming or stored for future use. This cooler reservoir system is especially useful on camping or boating trips or whenever access to water is limited.

These and other objects and features of the present invention will be better understood and appreciated from the following detailed description of one embodiment thereof, selected for purposes of illustration and shown in the accompanying drawings.

DETAILED DESCRIPTION

Figure 1:
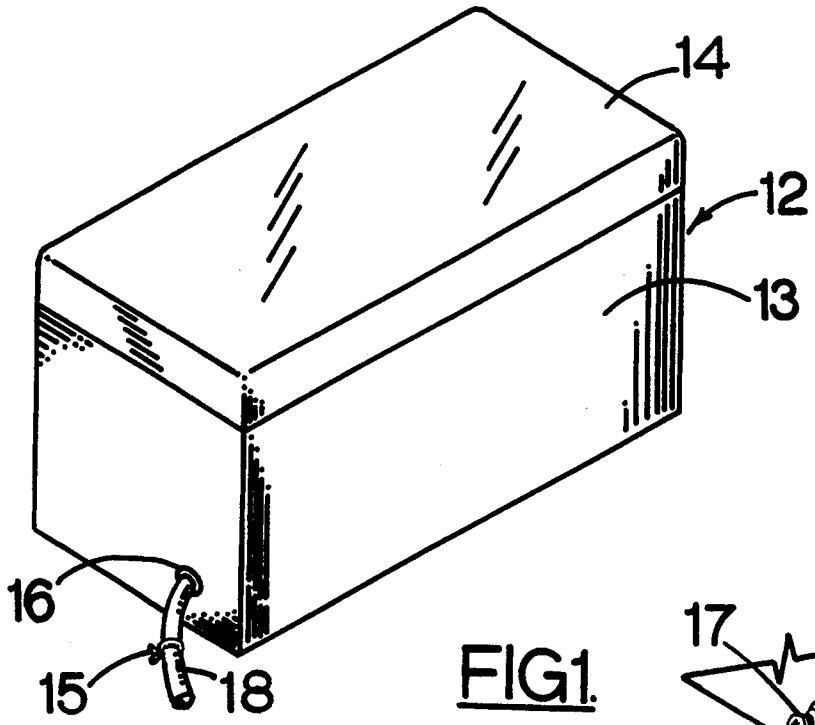
FIG. 1 is a perspective view of a conventional cooler with a drainage port. Tubing is shown extending from the cooler drain.

Referring now to the drawings there is shown a preferred embodiment of a cooler reservoir system.

Figure 1A:
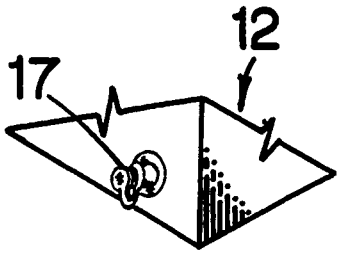
FIG. 1A is a is a partial perspective view of a cooler with an integral tap or valve at the drainage port.

A conventional cooler generally designated 12 shown in FIG. 1 includes a base portion 13 for storage and a cover 14 for access into cooler 12. Near the bottom of base portion 13 is a drainage port 16, shown connected to flexible tubing 18. A conventional spring clip or clamp 15 can be attached to flexible tubing 18 to limit or stop water flow as needed. FIG. 1A illustrates a cooler 12 having an integral tap or valve to limit or stop water flow.

Figure 2:
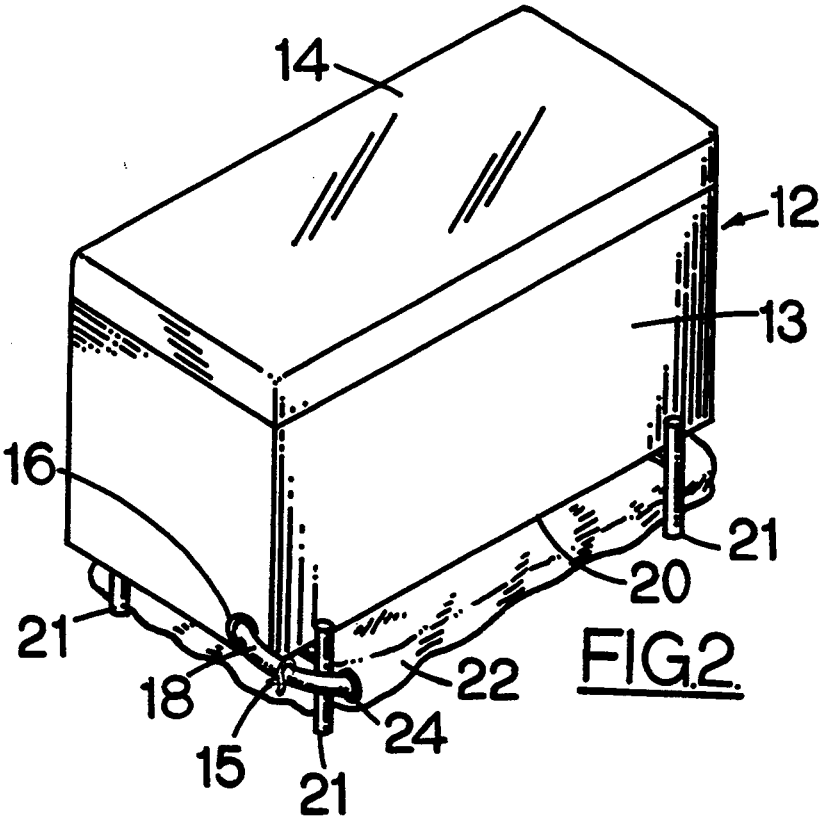
FIG. 2 is a perspective view of a conventional cooler supported by a platform. A reservoir bladder, located under the platform is connected to the cooler drain by flexible tubing.

FIG. 2 illustrates the cooler 12 in combination with a support platform 20 having support legs 21 and a collapsible reservoir bladder 22 having inlet port 24. The platform 20 supports the cooler 12 so as to allow the reservoir bladder 22 to be located below the cooler 12. This provides a more compact assembly, as well as providing maximum drainage from cooler 12.

Figure 3:
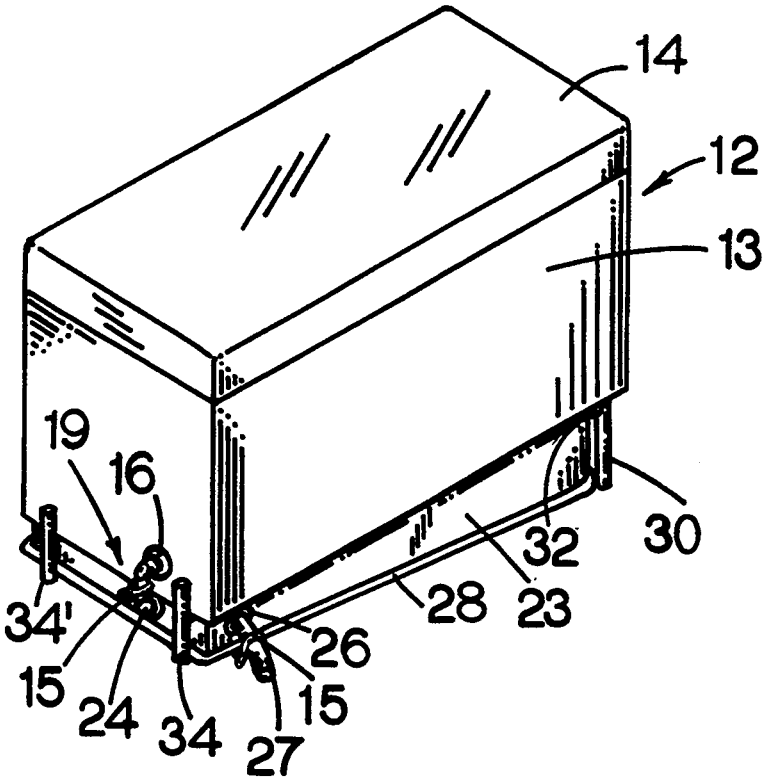
FIG. 3 is a perspective view of the cooler/platform-/reservoir of FIG. 2 wherein the platform is inclined and the reservoir is supported by a removable tray.

A rigid water bladder reservoir 23 is shown in FIG. 3. The reservoir 23 is optionally supported by a removable tray 28. This allows a water filled rigid reservoir 23 or a collapsible reservoir 22 (as shown in FIG. 2) to be easily moved from under the cooler 12 for use or storage. The cooler 12 is connected to reservoir 23 by rigid PVC piping 19 as illustrated in FIG. 3.

The reservoir 23 is shown with an outlet port 26 to empty the reservoir 22 through tubing 27. The support platform 32 having support legs 30, 30', 34, 34' is inclined towards the cooler drain 16 to facilitate drainage of the cooler 12. The cooler 12 rests against support legs 34, 34' which retain the cooler 12 on the platform 32.

Figure 4:
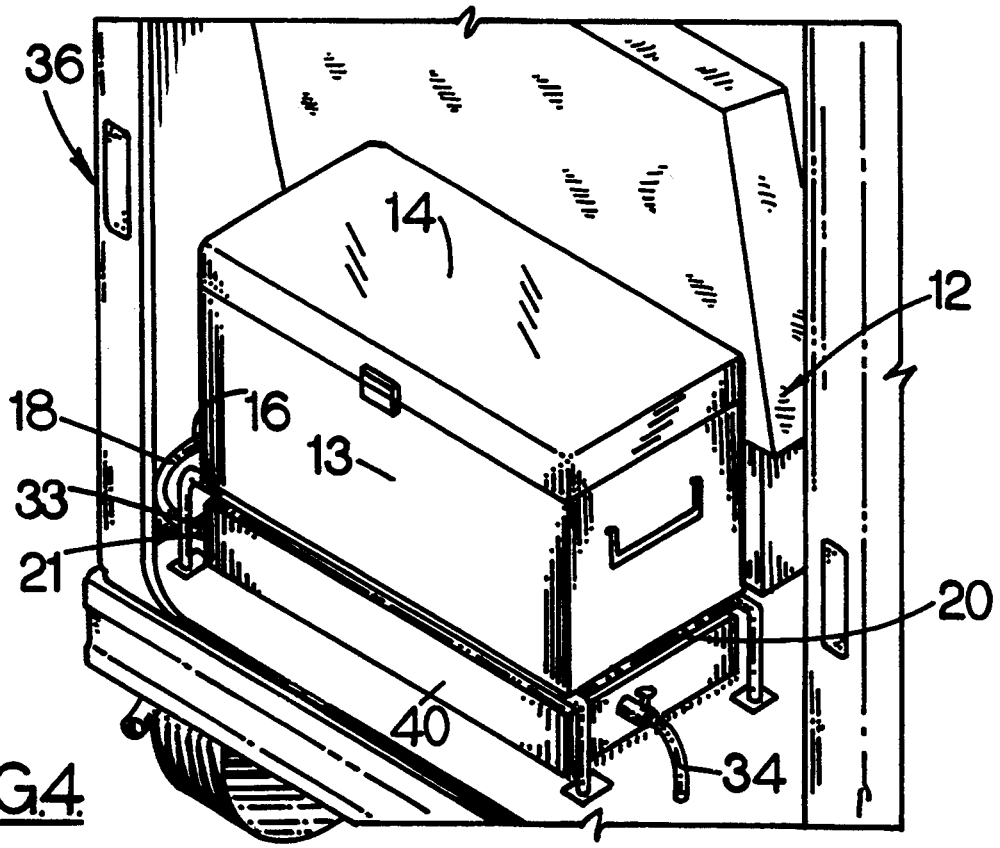
FIG. 4 is a perspective view of the cooler/platform-/reservoir of FIG. 2 wherein a reservoir basin, including a tap for drainage is used. The cooler reservoir system is shown assembled for use in a vehicle.

A reservoir basin 40 which is deep enough to prevent overflow of drained water can be utilized as shown in FIG. 4. Reservoir basin 40 is connected to the cooler 12 drainage port 16 by connector tubing 18 through basin inlet 33 and is located under platform 20. A spigot 34 located at a low position on the basin allows access to collected water. The cooler reservoir system is shown assembled in the rear of a vehicle generally designated 36. Continuous drainage from the cooler 12 is accomplished during operation of the vehicle 36 without threat of leakage, while storing the water in reservoir 40 for future use.

From the foregoing disclosure those skilled in the art will appreciate that all the objects of the present invention are realized. A system for continuous drainage of a commercially available insulated cooler is provided. As ice melts in the cooler, the resulting water is continuously drained from the cooler without unwanted leakage into a liquid reservoir, thereby preventing the presence of standing water in the cooler. Further, the reservoir stores water without waste for other uses such as cooking and bathing. Finally, the platform support system provides for compact use and storage of the cooler reservoir system.

While a specific embodiment has been shown and described, many variations are possible. The cooler and reservoir used may be made of any suitable material. The connecting device, while typically flexible tubing, may be any connection capable of transferring water from the cooler to the reservoir without leakage including for example a rigid PVC connector with snap or threaded fittings. The platform may be of any construction which facilitates drainage and compact assembly of the system. Further, the assemblies shown and described may be used outside as well as in a vehicle.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A combination ice container and liquid reservoir comprising:

an ice container means having a drainage port, a liquid reservoir means having an inlet port, the reservoir means being a collapsible waterproof reservoir bladder, a means to connect the container means to the reservoir means to allow liquid to flow from the container means into the reservoir means, and a container means support platform to allow reservoir means to be located under the container means and facilitate drainage from the container means into the reservoir means.

2. A combination ice container and reservoir as defined in claim 1 wherein the means to connect the ice container means to the reservoir means is flexible tubing leading from the container means drainage port to the reservoir means inlet port.

3. A combination ice container and reservoir as defined in claim 1 wherein the reservoir means includes a liquid outlet port to facilitate drainage of the reservoir.

4. A combination ice container and reservoir as defined in claim 1 wherein the liquid reservoir is a reservoir basin of sufficient depth to avoid overflow of the drained liquid.

5. A combination ice container and reservoir as defined in claim 1 wherein the reservoir is supported by a moveable tray to facilitate removal of the reservoir from under the container means.

6. A combination ice container and reservoir as defined in claim 1 wherein the container support platform is inclined downwardly toward the container drainage port to reduce the volume of undrained liquid remaining in the container.

7. A combination ice container and reservoir as defined in claim 1 wherein the ice container means is an insulated cooler.

8. A combination ice container and reservoir as defined in claim 1 wherein the drainage port and inlet port are integral.

9. A combination ice container and reservoir as defined in claim 1 wherein the means to connect the container means to the reservoir means is rigid piping leading from the container mans drainage port to the reservoir means inlet port.

10. A cooler drainage system for use with an insulated cooler having a drainage port comprising:

a liquid reservoir means having an integral inlet port, the reservoir means being a collapsible waterproof reservoir bladder, a cooler support platform under which the liquid reservoir means is located, and means to connect the liquid reservoir means inlet port to the cooler drainage port.

11. A cooler drainage system as defined in claim 10 wherein the means to connect the cooler to the reservoir is flexible tubing.

12. A cooler drainage system as defined in claim 10 wherein the reservoir means includes a liquid outlet port to facilitate drainage of the reservoir.

13. A cooler drainage system as defined in claim 10 wherein the reservoir is supported by a moveable tray to facilitate removal of the reservoir from under the cooler.

14. A cooler drainage system as defined in claim 10 wherein the cooler support platform is inclined downwardly toward the cooler drainage port to reduce the volume of liquid remaining in the cooler.

15. A combination cooler and water reservoir comprising:

an insulated cooler having an integral drainage port, a collapsible waterproof bladder water reservoir having an integral inlet port, flexible tubing to connect the cooler to the reservoir to allow liquid to flow from the cooler into the reservoir, clamping means to limit or stop the flow of water through the tubing, and a cooler support platform to allow the reservoir to be located under the cooler and facilitate drainage from the cooler in to the reservoir's means.

* * * * *